US006347792B1

(12) United States Patent
O'Brien

(10) Patent No.: US 6,347,792 B1
(45) Date of Patent: Feb. 19, 2002

(54) MECHANIC'S VISE

(76) Inventor: Orlin P. O'Brien, P.O. Box 668, Whitmore Lake, MI (US) 48189-0668

( * ) Notice: Subject to any disclaimer, the term of this patent is extended or adjusted under 35 U.S.C. 154(b) by 0 days.

(21) Appl. No.: 09/710,048

(22) Filed: Nov. 10, 2000

(51) Int. Cl.[7] ..... B25B 1/10
(52) U.S. Cl. ..... 269/246; 269/225; 269/244; 269/43
(58) Field of Search ..... 269/241, 242, 269/244, 246, 43, 329; 81/473, 474, 475, 476, 477

(56) References Cited

U.S. PATENT DOCUMENTS 4,046,364 A * 9/1977 Coope et al. ..... 269/244
4,685,663 A * 8/1987 Jorgensen ..... 269/244
5,683,077 A * 11/1997 Fink et al. ..... 269/244
5,887,860 A * 3/1999 Hong ..... 269/225

* cited by examiner

*Primary Examiner*—Joseph J. Hail, III
*Assistant Examiner*—Daniel Shanley
(74) *Attorney, Agent, or Firm*—Alex Rhodes

(57) ABSTRACT

A mechanic's bench vise which is easy to use and increases the maximum level of clamping force on a workpiece in a pair of jaws of the vise. Another benefit is that it allows a vise to be used performing operations such as installing bushings, die punching holes, and setting rivets. One feature of the invention is that it measures the amount of torque which is applied to the torque arm. The invention broadly comprises a vise having at least one long slender torque arm for opening and closing a pair of jaws of a vise and a ratchet for opening and closing a pair of jaws of the vise. In a first aspect of the invention, the torque arm is not intended to be removed from the vise during normal service. In a second aspect, the length of the torque arm is adjustable. In a third aspect, the torque is removable for shipping and storage and to allow the use of different style and length torque arms. In a fourth aspect, the torque arm is calibrated to measure the clamping force on a workpiece which is clamped in the jaws.

14 Claims, 6 Drawing Sheets

20

20

20

20

PRIOR ART

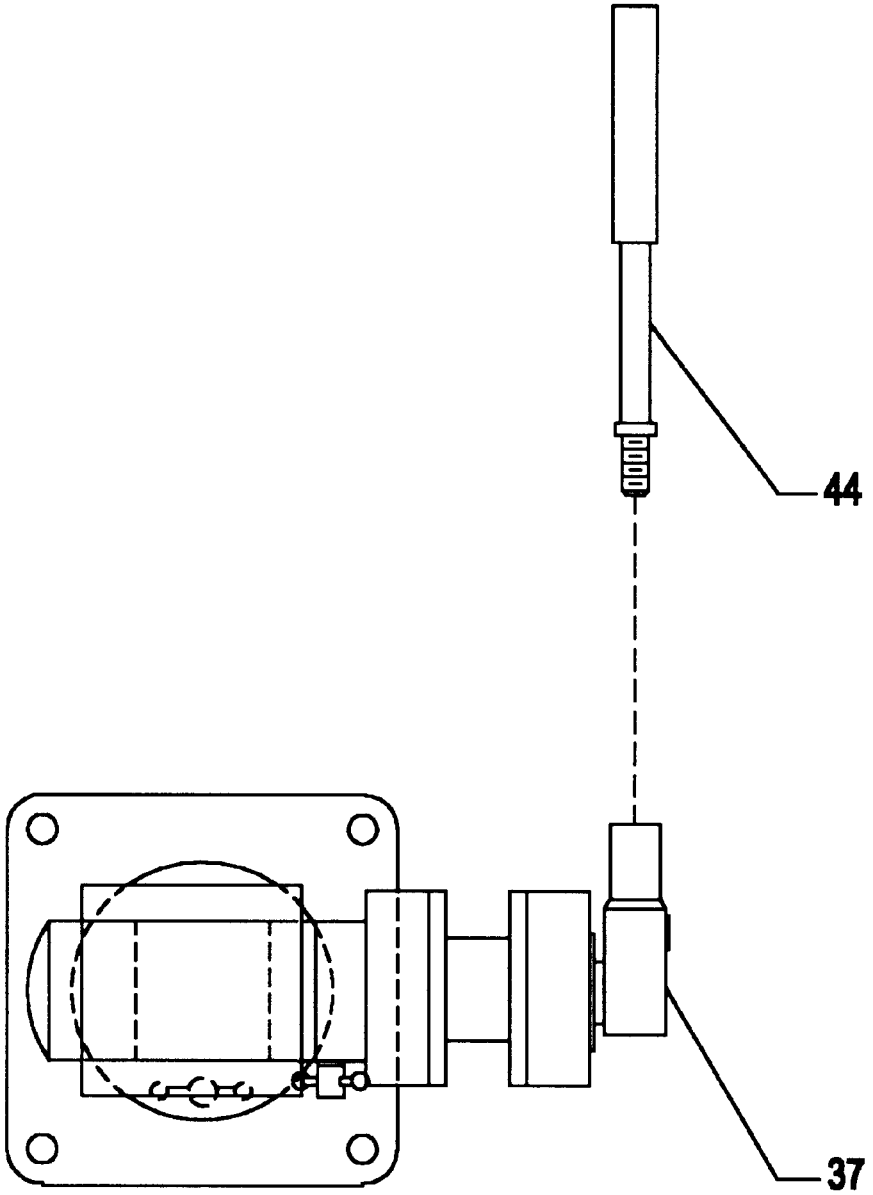
FIG. 8
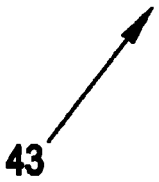

MECHANIC'S VISE

FIELD OF THE INVENTION

This invention relates to a mechanic's vise and more particularly to an easy to use mechanic's vise for measuring and generating high clamping forces.

BACKGROUND OF THE INVENTION

The mechanic's bench top vise is commonly used during operations such as assembly, drilling, tapping, sawing, filing, welding, brazing and soldering. One drawback with existing mechanic's vises is that they have a limited ability for generating high clamping forces. Another drawback is that they are difficult to use in crowded working conditions. Another drawback is that they lack of a means for measuring clamping forces.

SUMMARY OF THE INVENTION

The present invention eliminates all the above drawbacks. Another benefit is that it can be used for operations, such as installing bushings, die punching holes and setting rivets. These operations currently require equipment such as punch presses and arbor presses. Another benefit is that it can reduce the time for closing and opening vise jaws. One feature of the invention is a means for measuring the amount of torque which is applied to a long slender torque arm.

The invention broadly comprises a vise having at least one long slender torque arm for opening and closing a pair of jaws of a vise and a ratchet for opening and closing a pair of jaws of the vise. In a first aspect of the invention, the torque arm is not intended to be removed from the vise during normal service. In a second aspect, the length of the torque arm is adjustable. In a third aspect, the torque is removable for shipping and storage and to allow the use of different style and length torque arms. In a fourth aspect, the torque arm is calibrated to measure the clamping force on a workpiece which is clamped in the jaws.

Further objects and features will become apparent from the ensuing detailed descriptions of preferred embodiments. The property in which exclusive rights are claimed are set forth in each of the numbered claims at the conclusion of the detailed description.

BRIEF DESCRIPTIONS OF THE DRAWINGS

The invention will be better understood and further objects, characterizing features, details and advantages thereof will appear more clearly with reference to the diagrammatic drawing illustrating a presently preferred specific embodiment of the invention by way of non-limiting example only.

FIG. 8 is a plan view of a third embodiment.

DETAILED DESCRIPTIONS OF PREFERRED EMBODIMENTS

Figure 1:
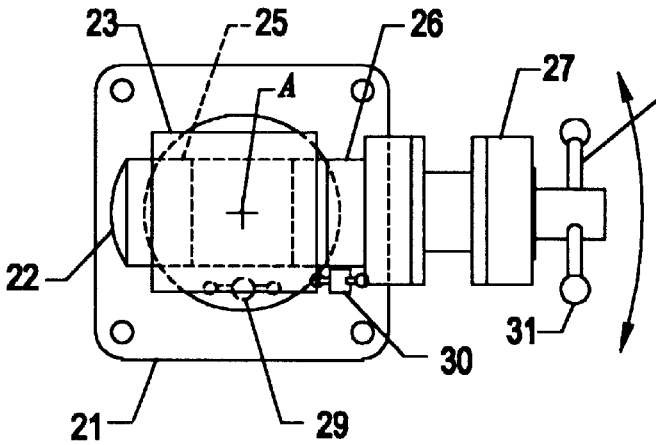
FIG. 1 is plan view of a typical bench top mechanic's vise of the prior art.
Figure 4:
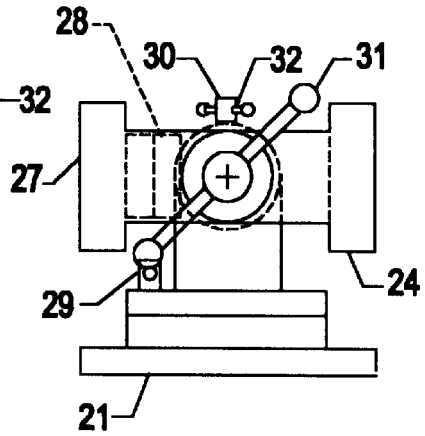
FIG. 4 is a front view of the mechanic's vise showing the jaws of the vise in a rotated position.
Figure 2:
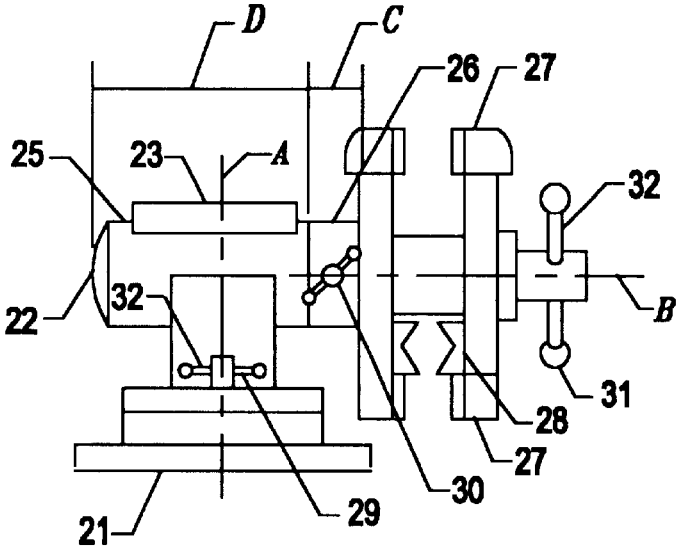
FIG. 2 is a right side view of the prior art mechanic's vise.
Figure 3:
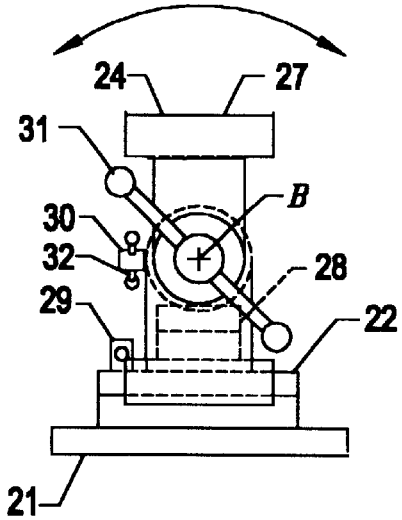
FIG. 3 is a front view of the mechanic's vise.

Referring to the drawings wherein like numerals designate like and corresponding parts throughout the view, a bench top mechanic's vise 20 of the prior art is shown in FIGS. 1 through 4, inclusive. The mechanic's vise 20 is comprised of a base 21, a body 22 mounted for rotation on the base 21 about a vertical axis "A", an anvil 23 mounted on the body 22, and three pairs of jaws 27, 28 mounted on the body 22 for rotation about a horizontal axis "B".

The body 22 is divided into a rear section 25 having a length "D" which is fixed to the base 21 and a front section 26 having a length "C" which is mounted for rotation on the rear section 25. The three pairs of jaws 27, 28 consist of two pairs of flat jaws 27 and a single pair of V-jaws 28. Two turnstiles 29, 30 clamp the body 22 to the base 21 and the body's front section 26 to the body's rear section 25. A third turnstile 31 rotates an input shaft to open and close the jaws 27, 28. The turnstiles 29, 30, 31 have short arms 32 which limit the amount of torque which can be applied to the turnstiles 29, 30, 31.

On a crowded bench top, the arms 32 are often difficult or impossible to rotate the arms 32 through large angles without shifting the arms 32 in the turnstiles 29, 30, 31 back and forth a number of times. Shifting the arms 32 back and forth in the turnstiles 29, 30, 31 can increase the amount of time for opening and closing the jaws.

Another drawback is that the position of the arms 32 often deviates from an optimum (horizontal) position for exerting maximum torque. Another drawback is that workpieces are often damaged because of excessive clamping forces by the jaws 27, 28.

Figure 5:
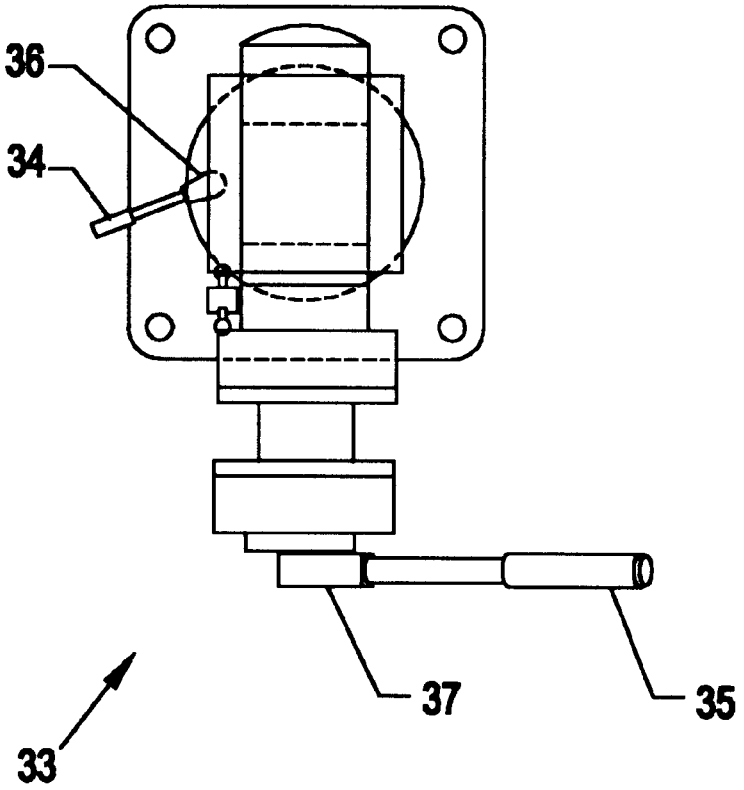
FIG. 5 is a plan view of a mechanic's vise according to the present invention.
Figure 6:
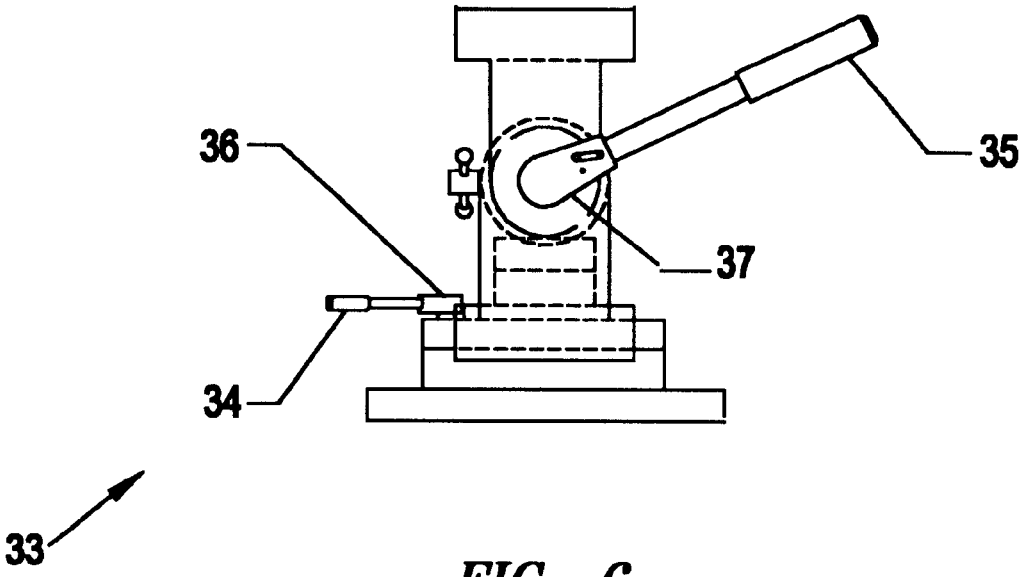
FIG. 6 is a front view of the vise shown in FIG. 5.

With reference to FIGS. 5 and 6, an improved mechanic's vise 33 is shown according to the present invention. One advantage of the improved vise 33 is that few, if any, modifications are necessary for adapting the invention to an exiting vise 20. In the improved vise 33, the turnstiles 29, 31 are replaced with long slender torque arms 34, 35. The torque arms 34, 35 are mechanically coupled to shafts with ratchets 36, 37 which allow clamping under crowded conditions to be accomplished by merely rotating the torque arms 34, 35 back and forth through small angles. Moreover, the ratchets 36, 37 allow the torque arms 34, 35 to be oriented in optimum positions for producing maximum torque. The ratchets 36, 37 are conventional type ratchets which can be set to operate in opposite directions.

The longer torque arms 34, 35 further increase the maximum torque and reduce manual efforts for producing lower levels of torque. Another benefit is that the time for opening and closing the jaws 27, 28 can be reduced. It will be appreciated that a torque arm and ratchet (not shown) can be used in place of the turnstile 30 which is used for clamping the front section 26 to the rear section 25.

Figure 7:
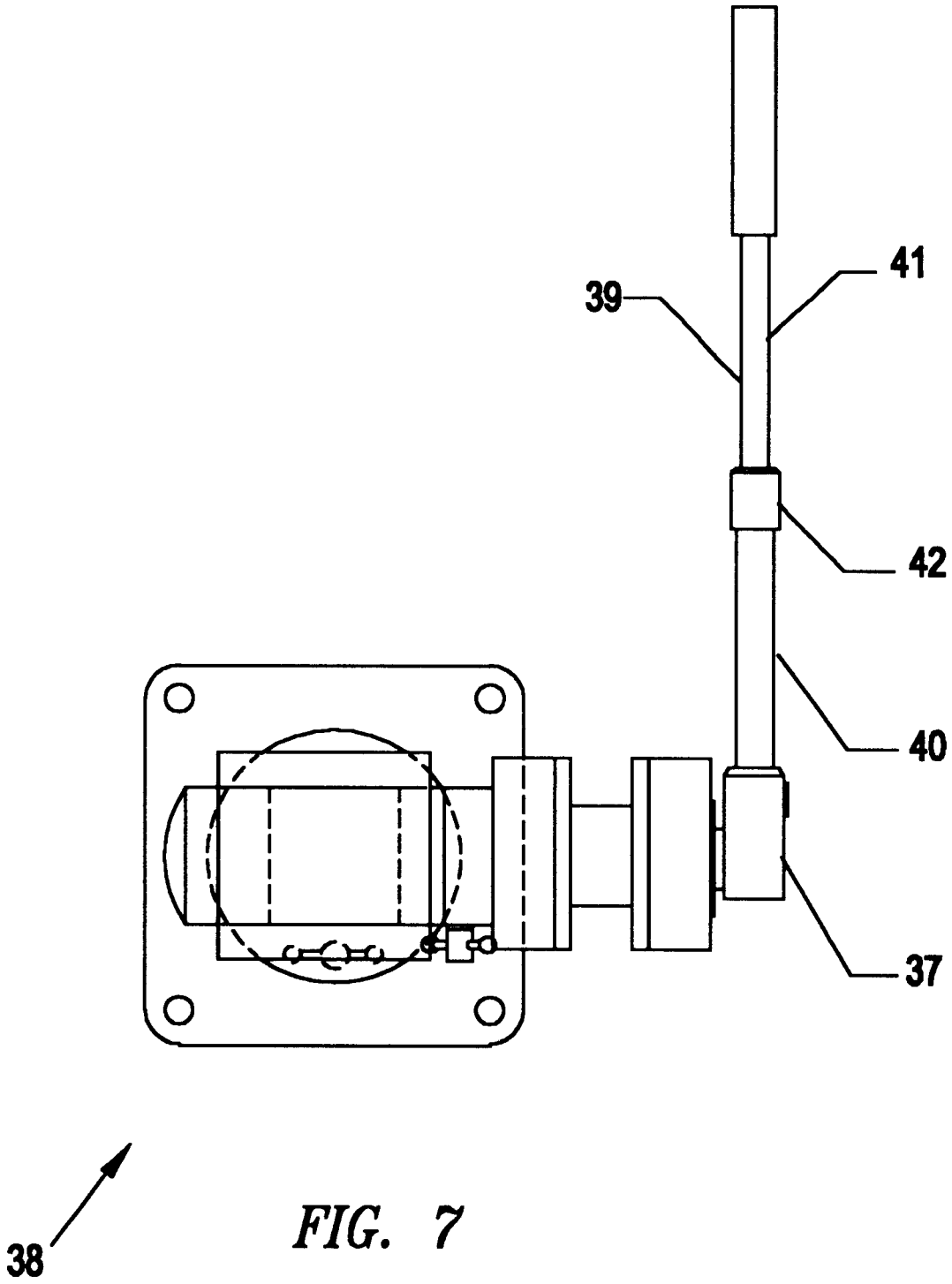
FIG. 7 is a plan view of a second embodiment.

In FIG. 7, an embodiment 38 is shown wherein the length of the torque arm 39 is adjustable. The torque arm 39 is comprised of a slender lower tubular portion 40, a smaller diameter telescoping upper portion 41 and a lock nut 42. This embodiment 38 provides the advantage of allowing a shortening of the torque arm 39 during non-use, shipping and storage. In the vise 43 shown in FIG. 8, the torque arm 44 is removable. The removable torque arm 44 allows the use of alternate type and length torque arms.

Figure 9:
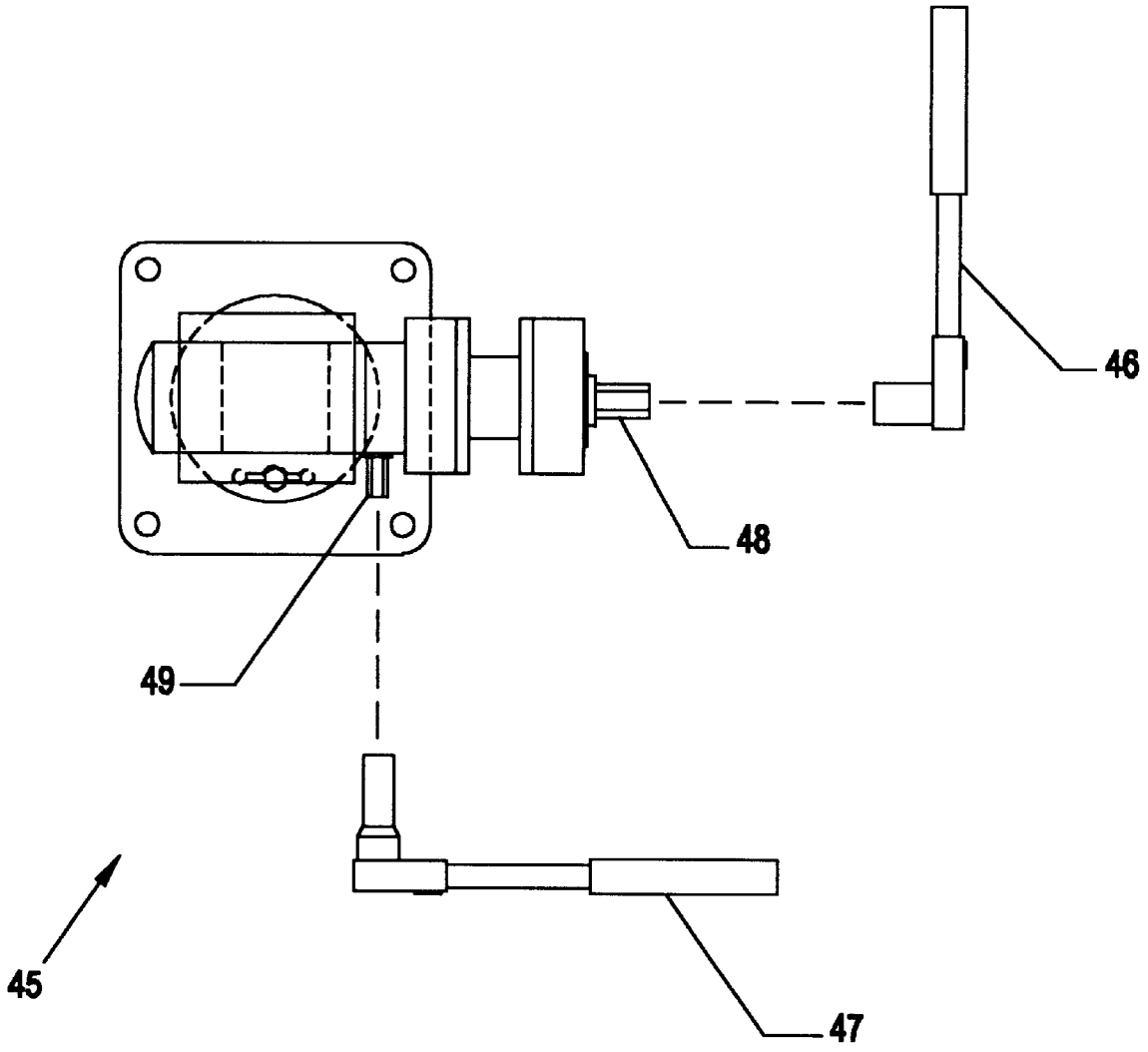
FIG. 9 is a plan view of a fourth embodiment.

In FIG. 9, an embodiment 45 is shown consisting of a pair of ratchet type socket wrenches and input shafts with male hexagonal, square or serrated end portions for receiving the socket wrenches. This embodiment 45 provides the advantage of allowing a mechanic to use a variety of available tools.

Figure 10:
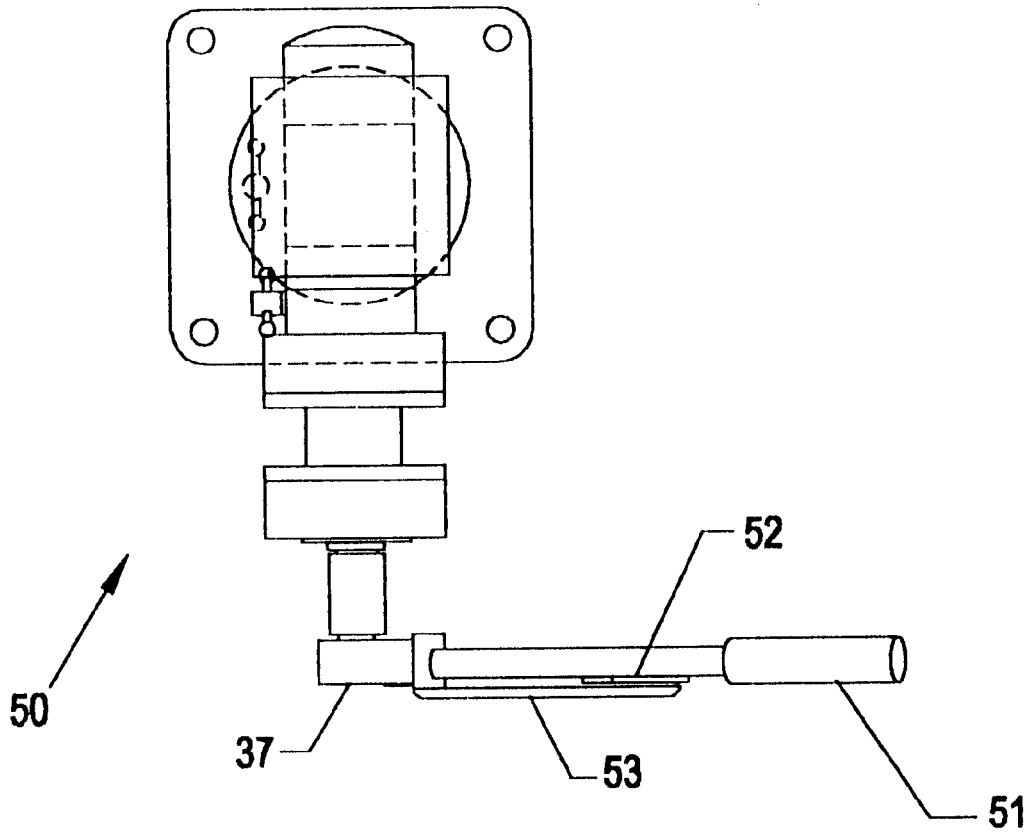
FIG. 10 is a plan view of a fifth embodiment.
Figure 11:
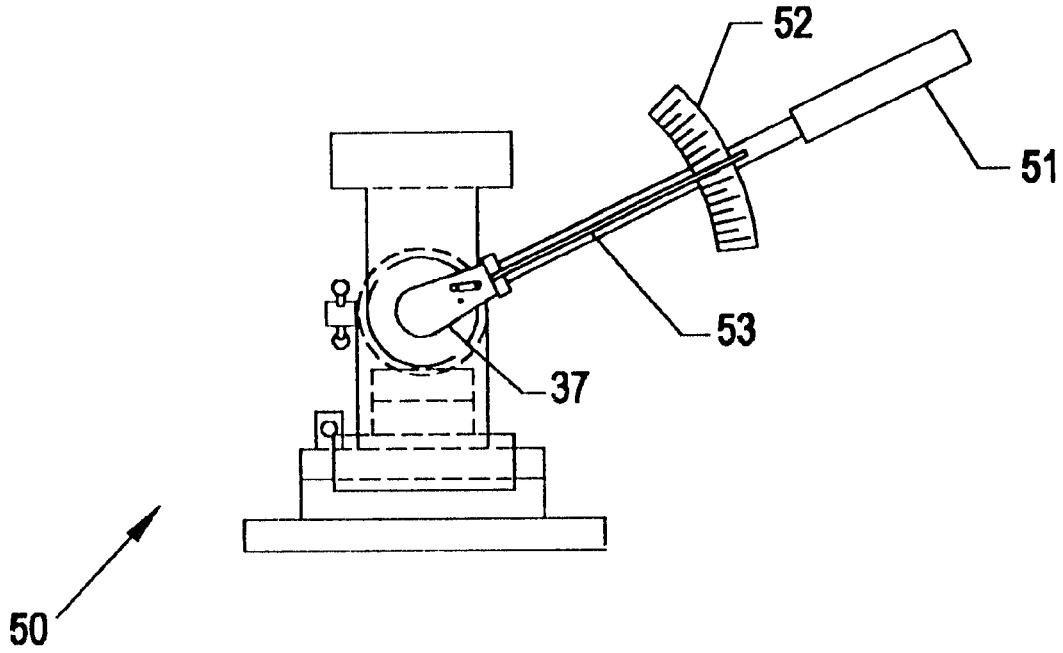
FIG. 11 is a front view of the fifth embodiment.

In FIGS. 10 and 11, an embodiment 50 is shown which provides the important benefit of the ability of measuring the clamping force of the jaws 27, 28. The torque arm 51 includes a calibrated sector 52 and pointer 53 for indicating the amount of torque which is applied to an input shaft. The torque arm 53 is coupled to a hex end portion of the input shaft with a ratchet at the end of the arm. The clamping force of the jaws is directly proportional to the torque which is measured on the torque arm.

From the foregoing it will be understood that my invention provides important benefits in a mechanic's bench vise which have been heretofore unavailable. It increases the utility of a bench vise by increasing the clamping force of the jaws which hold a workpiece. This allows the vise to be used for purposes other than holding a workpiece. It further provides a mechanic with a means for reducing damage to a workpiece by providing the mechanic with a measure of the clamping force on the workpiece.

Although only several embodiments of my invention have been illustrated and described, it is not my intention to limit the scope of the claims to these embodiments, since other embodiments can be developed by such changes as an inversion of elements, substitutions of materials, and re-arrangements of parts without departing from the spirit thereof.

What I claim is new is:

1. In a mechanic's bench top vise of the type having at least one pair of jaws for clamping a workpiece in said vise and a rotatable input shaft for closing and opening said jaws, an improvement comprising: a substantially long slender torque arm for generating high clamping forces of said jaws on a workpiece, said long slender torque arm rotating said input shaft to close and open said jaws; and a non-torque limiting coupling for coupling said torque arm to said input shaft of said bench top vise, said coupling including a reversible ratchet for opening and closing said jaws under crowded bench top conditions.

2. The improvement recited in claim 1 wherein said torque arm has a length which is adjustable.

3. The improvement recited in claim 1 wherein said torque arm is detachable from said input shaft.

4. The improvement recited in claim 3 wherein said input shaft of said bench top vise has a male square end portion and said coupling has a female square end portion for engaging said male square end portion of said input shaft.

5. The improvement recited in claim 3 wherein said input shaft of said bench top vise has a male hexagonal end portion and said torque arm has a female hexagonal end portion for engaging said male hexagonal end portion of said input shaft.

6. The improvement recited in claim 3 wherein said input shaft of said bench top vise has a male serrated end portion and said torque arm has a female serrated end portion for engaging said male serrated end portion of said input shaft.

7. The improvement recited in claim 3 further comprising a plurality of detachable torque arms of different lengths for providing optional levels of maximum torque which can be applied by said torque arm.

8. The improvement recited in claim 1 further comprising a non torque limiting means on said torque arm for measuring the amount of torque which is applied to said torque arm.

9. The improvement recited in claim 8 wherein said non torque limiting means for measuring the amount of torque is comprised of a calibrated sector, attached to an upper portion of said slender arm; and a pointer attached to a lower end portion of said arm.

10. In a mechanic's bench top vise of the type having at least one pair of jaws for clamping a workpiece, a jaw rotating means for rotating said jaws about a vertical axis, a rotatable input shaft for closing and opening said jaws, an improvement comprising: a first slender torque arm for rotating said input shaft to close and open said jaws; a first reversible ratchet for coupling said torque arm under crowded bench top conditions to said rotatable input shaft; a second slender arm for clamping said jaw rotating means about said vertical axis; and a second reversible ratchet for coupling said second slender torque arm to said jaw rotating means under crowded bench top conditions.

11. In combination with a vise having a long slender torque arm for opening and closing a pair of jaws of said vise, a non torque limiting means for measuring the amount of torque which is applied to said long slender torque arm.

12. In combination with a vise having a substantially long slender torque arm for increasing the clamping force of a pair of jaws of said vise, a reversible non torque limiting ratchet for coupling said long slender torque arm to said vise and rotating an input shaft of said vise during crowded bench top conditions.

13. A vise for clamping a workpiece, comprising: at least one pair of jaws; a detachable substantially long slender torque arm for opening and closing said jaws and increasing a clamping force or said jaws; a reversible non-torque limiting ratchet for coupling said long slender torque arm to an input shaft of said vise; and a means in said torque arm for measuring the amount of force which is applied to a workpiece which is clamped in said jaws.

14. The vise recited in claim 13 wherein an angular orientation of said jaws is adjustable and further comprising a torque arm for clamping said angular orientation of said jaws in said vise and a second reversible ratchet for clamping said jaws in said angular orientation of said vise.

* * * * *